US009564709B1

(12) United States Patent
Yang

(10) Patent No.: US 9,564,709 B1
(45) Date of Patent: Feb. 7, 2017

(54) CONNECTOR WITH NEW FASTENING STRUCTURE

(71) Applicant: Amphenol East Asia Electronic Technology (Shen Zhen) Co., Ltd., Shenzhen (CN)

(72) Inventor: Cunka Yang, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/014,697

(22) Filed: Feb. 3, 2016

(51) Int. Cl.
*H01R 13/627* (2006.01)

(52) U.S. Cl.
CPC ..... *H01R 13/6277* (2013.01)

(58) Field of Classification Search
USPC ..... 439/349, 345, 347, 352
See application file for complete search history.

(56) References Cited

U.S. PATENT DOCUMENTS

| | | | | |
|---|---|---|---|---|
| 5,018,985 A * | 5/1991 | Moore | H01R 13/514 29/883 |
| 5,895,292 A * | 4/1999 | Affeltranger | H01R 13/518 439/607.56 |
| 7,413,464 B1 * | 8/2008 | Chen | H01R 4/2433 439/404 |
| 2011/0177710 A1 * | 7/2011 | Tobey | H01R 13/514 439/345 |
| 2011/0217880 A1 * | 9/2011 | Schmidt | H01R 13/506 439/676 |

* cited by examiner

*Primary Examiner* — Alexander Gilman
(74) *Attorney, Agent, or Firm* — Maier & Maier, PLLC

(57) ABSTRACT

The connector comprises a main body and a connecting body, the rear end of the main body and the front end of the connecting body are clamped. A plugging needle is disposed in the front shell and the cable connecting tube. A snap ring groove is disposed at the front end of the periphery of the connecting tube and is located below the plugging hole when the main body and the connecting body are connected together. A plugging hole is located on the outer periphery of the connecting body. The plugging pin is an arc plate and includes two clamping points, located on one of the ends of the top portion of the plugging pin. When the main body and the connecting body are connected, the plugging pin may be plugged through the plugging hole and stuck in the groove, and the clamping points of the plugging pin are clamped.

2 Claims, 2 Drawing Sheets

CONNECTOR WITH NEW FASTENING STRUCTURE

TECHNICAL FIELD

The present invention relates to the field of connector, particularly to a connector with new fastening structure.

BACKGROUND

Nowadays, conventional connectors are connected in a direct-depressing manner, which are inclined to be damaged due to repeated plugging over a long period of time, and their connection will become loose as time goes by.

SUMMARY OF THE INVENTION

To solve the above mentioned technical problem, the present invention provides a connector with new and optimized fastening structure that makes its connection more reliable and free of looseness. To be specific, the present invention provides a connector with new fastening structure, the connector comprises a main body and a connecting body, the rear end of the main body and the front end of the connecting body are clamped together.

The main body includes a front shell, a cable connecting tube, a plugging needle and a snap ring groove. The connecting body includes a plugging hole, clamp positions and a plugging pin. Specifically, the rear end of the front shell and the front end of the cable connecting tube are connected together. The plugging needle is disposed in the front shell and the cable connecting tube. The snap ring groove is disposed at the front end of the outer periphery of the cable connecting tube, and is located just below the plugging hole when the main body and the connecting body are connected together and the cable connecting tube is inserted into the connecting body.

The plugging hole is located on the front end of the outer periphery of the connecting body. The clamp positions are located on two sides of the plugging hole. The plugging pin is an arc plate and includes two clamping points, respectively located on one of the two ends of the top portion of the plugging pin. When the main body and the connecting body are connected together, the lower portion of the plugging pin may be plugged through the plugging hole and stuck in the snap ring groove, and the clamping points on the top portion of the plugging pin are respectively clamped within the clamp positions.

In a further optimized technical solution, the plugging needle is connected with cable.

Following beneficial effects are achieved by the present invention thanks to employment of the above technical solutions. Specifically, compared with disclosed technical solutions in the art, the present connector with new fastening structure differs from a conventional connector in that it is provided with a plugging pin and a plugging hole, such that the reliability of the present connector is improved, and the connection will not fail under external force. The securing steps particularly include: plug the main body into the connecting body, making the snap ring groove located just below the plugging hole, insert the plugging pin through the plugging hole and clamp it in the snap ring groove, meanwhile the clamping points of the plugging pin are respectively clamped within the clamp positions of the plugging hole, thereby attaining a better fixing effect.

DETAILED DESCRIPTION

The present invention will be set forth in connection with FIG. 1 and FIG. 2 and the specific embodiments, all of which are in no way intended to limit the present invention.

Embodiment 1

Figure 1:
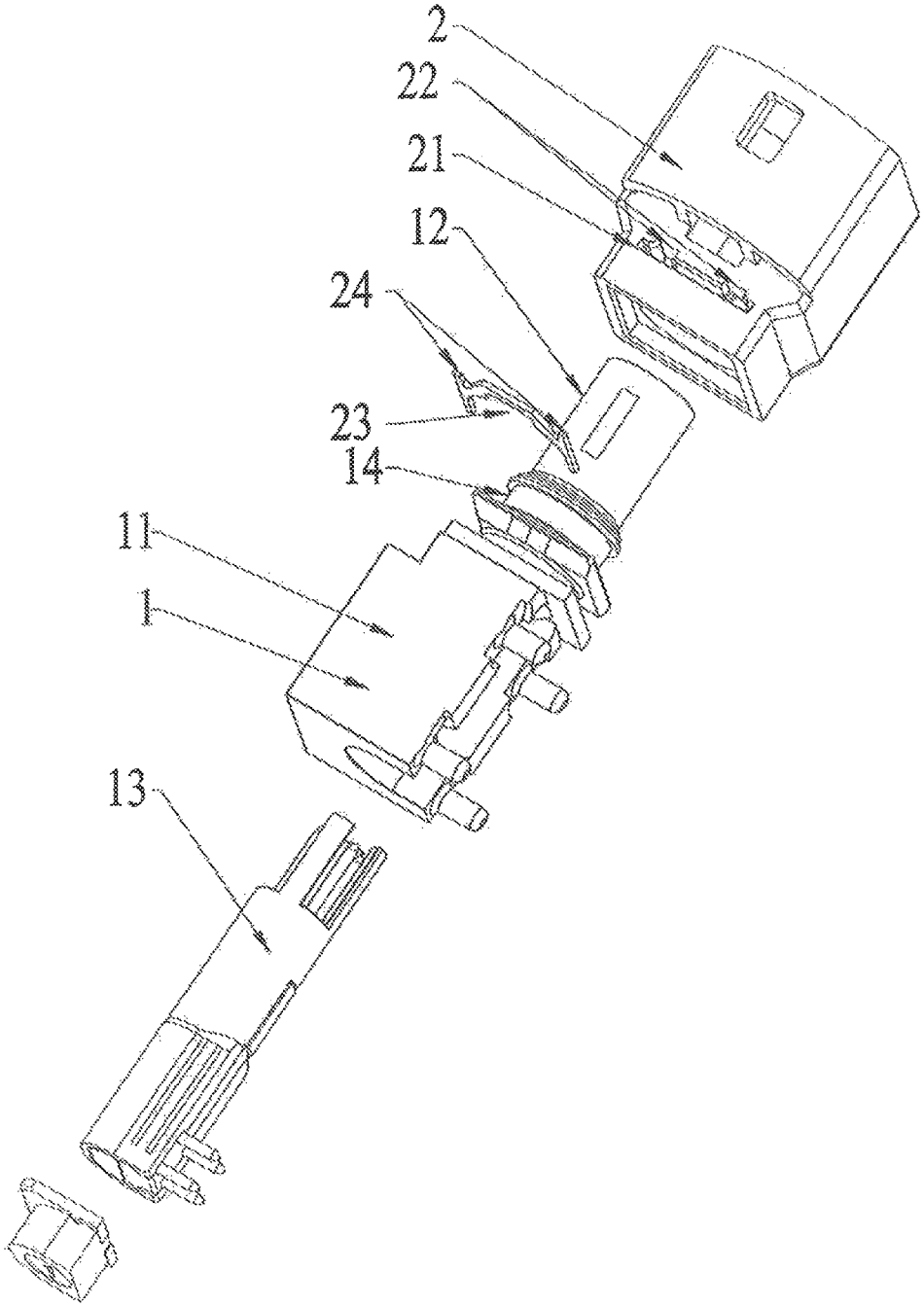
FIG. 1 is an exploded view of a connector with new fastening structure.
Figure 2:
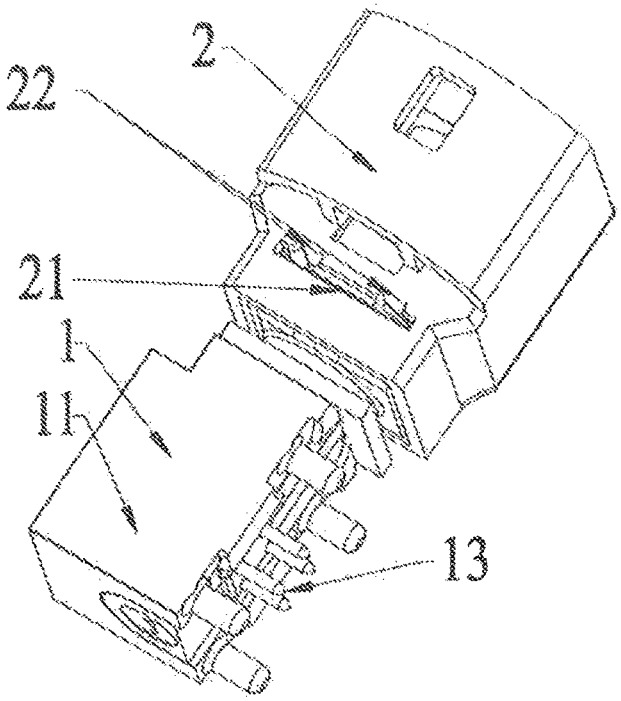
FIG. 2 is a schematic view of the connector with new fastening structure shown in connection state.

As shown in FIG. 1 and FIG. 2, a connector with new fastening structure comprises a main body 1 and a connecting body 2, the rear end of the main body 1 is clamped with the front end of the connecting body 2.

The main body 1 includes a front shell 11, a cable connecting tube 12, a plugging needle 13 and a snap ring groove 14. The connecting body 2 includes a plugging hole 21, clamp positions 22 and a plugging pin 23. Specifically, the rear end of the front shell 11 is connected with the front end of the cable connecting tube 12. The plugging needle 13 is disposed in the front shell 11 and the cable connecting tube 12, and connected with a cable. The snap ring groove 14 is disposed at the front end of the outer periphery of the cable connecting tube 12, and is located just below the plugging hole 21 when the main body 1 and the connecting body 2 are connected together.

The plugging hole 21 is disposed on the front end of the outer periphery of the connecting body 2. The clamp positions 22 are located on two sides of the plugging hole 21. The plugging pin 23 is an arc plate and includes two clamping points 24, respectively located on one of the two ends of the top portion of the plugging pin 23. When the main body 1 and the connecting body 2 are connected together, the lower portion of the plugging pin 23 may be plugged through the plugging hole 21 and stuck in the snap ring groove 14, and at the same time the clamping points 24 on the top portion of the plugging pin 23 are respectively clamped within the clamp positions 22.

It is known from general technical knowledge that the present technical solutions can be achieved by other embodiments which do not depart from the spiritual substance or essential features of the present invention. Therefore, the above mentioned embodiments, in various aspects, are merely illustrative rather than exclusive. All changes within the scope of the present invention or the scopes equivalent to that of the present invention are intended to be included within the present invention.

The invention claimed is:

1. A connector with new fastening structure comprising:

a main body and a connecting body, the rear end of the main body is clamped with the front end of the connecting body;

wherein the main body includes a front shell, a cable connecting tube, a plugging needle and a snap ring groove, the connecting body includes a plugging hole, clamp positions and a plugging pin;

wherein the rear end of the front shell is connected with the front end of the cable connecting tube;

wherein the plugging needle is disposed in the front shell and the cable connecting tube;

wherein the snap ring groove is disposed at the front end of the outer periphery of the cable connecting tube, and is located just below the plugging hole when the main body and the connecting body are connected together;

wherein the plugging hole is disposed on the front end of the outer periphery of the connecting body;

wherein the clamp positions are disposed on two sides of the plugging hole;

wherein the plugging pin is an arc plate and includes two clamping points, each located on one of the two ends of the top portion of the plugging pin;

wherein when the main body and the connecting body are connected together, the lower portion of the plugging pin may be plugged through the plugging hole and stuck in the snap ring groove, with the clamping points on the upper portion of the plugging pin respectively being clamped within the clamp positions.

2. The connector with new fastening structure as set forth in claim 1, wherein the plugging needle is connected with a cable.

* * * * *